United States Patent [19]

Chivers

[11] Patent Number: 4,875,621

[45] Date of Patent: Oct. 24, 1989

[54] APARTMENT MAILBOX SIGNAL DEVICE

[76] Inventor: Dolores Chivers, 3109 Clinton Ave. South, Minneapolis, Minn. 55408

[21] Appl. No.: 212,340

[22] Filed: Jun. 27, 1988

[51] Int. Cl.[4] ..... B65D 91/00; A47G 29/12

[52] U.S. Cl. ..... 232/34; 234/24

[58] Field of Search ..... 232/24, 34, 21, 35

[56] References Cited

U.S. PATENT DOCUMENTS

| | | | |
|---|---|---|---|
| 621,973 | 3/1899 | Peers | 232/34 |
| 1,620,474 | 3/1927 | Krick | 232/24 X |
| 2,334,647 | 11/1943 | Qualls | 232/24 |
| 2,801,046 | 7/1957 | Mirkin | 232/34 |
| 3,143,287 | 9/1962 | Holt . | |
| 3,144,986 | 3/1962 | Hendrickson . | |
| 3,331,552 | 5/1966 | Shultz . | |
| 3,391,861 | 9/1966 | Seckler . | |
| 3,392,911 | 11/1966 | Clark . | |
| 3,467,303 | 5/1967 | Saatzer . | |
| 3,602,423 | 12/1968 | Corkery . | |
| 3,602,424 | 6/1969 | Raulston . | |
| 3,608,524 | 12/1970 | Korinek . | |
| 3,623,655 | 4/1970 | Reedley . | |
| 3,648,924 | 8/1970 | Burns . | |
| 3,650,464 | 3/1970 | Lewis . | |
| 3,735,919 | 5/1973 | Morgan | 232/34 X |
| 3,747,839 | 11/1971 | Morton . | |
| 3,819,109 | 6/1974 | Ucciardino | 232/24 |
| 3,830,424 | 8/1973 | Pittman . | |
| 3,866,823 | 2/1974 | Grayson . | |
| 3,889,874 | 3/1974 | Arwood . | |
| 3,958,752 | 1/1975 | Pieszchala . | |
| 4,018,379 | 3/1976 | Carter . | |
| 4,065,050 | 1/1977 | Hunt . | |
| 4,072,265 | 5/1977 | Jones . | |
| 4,073,430 | 10/1976 | Joris . | |
| 4,089,460 | 5/1976 | Mellard . | |
| 4,113,170 | 7/1977 | Hunsicker . | |
| 4,138,056 | 11/1977 | Sherrill . | |
| 4,147,292 | 12/1977 | Fisher . | |
| 4,150,780 | 4/1978 | Mapes . | |
| 4,154,392 | 7/1978 | Galstad et al. . | |
| 4,158,430 | 6/1978 | Wideman . | |
| 4,186,870 | 7/1978 | Walden . | |
| 4,201,334 | 9/1978 | Janik . | |
| 4,202,486 | 3/1979 | Tipsword . | |
| 4,316,575 | 6/1980 | VanDarwarka . | |
| 4,318,507 | 5/1980 | Thopsey et al. . | |
| 4,365,740 | 8/1980 | Whitley et al. . | |
| 4,390,122 | 7/1981 | Savko . | |
| 4,449,663 | 9/1983 | Schluter . | |
| 4,552,302 | 6/1984 | Rung . | |
| 4,570,846 | 12/1984 | Morgrey . | |
| 4,697,733 | 3/1987 | Todd . | |
| 4,711,391 | 2/1987 | Roge . | |
| 4,712,731 | 7/1986 | Gramelspacher . | |
| 4,720,042 | 4/1981 | Tapy . | |
| 4,728,028 | 5/1987 | Barnes . | |
| 4,738,392 | 4/1987 | Kovacs . | |

*Primary Examiner*—Robert W. Gibson, Jr.
*Attorney, Agent, or Firm*—Dorsey & Whitney

[57] ABSTRACT

An apartment mailbox signal device to indicate the presence of outgoing mail in an apartment mailbox is comprised of a detachable mounting base having means for engaging a rotatable arm, a generally L-shaped rotatable arm for supporting a signal means, and a signal means connected to the rotatable arm indicating the presence of outgoing mail in the mailbox. The mounting base includes means for selectively securing the mounting base to an interior wall of the apartment mailbox and means for receiving or supporting the rotatable arm. The generally L-shaped rotatable arm is comprised of a vertical pivot member and a horizontal support member. The vertical member is received within the mounting base such that it may pivot about an axis parallel with the interior wall of the mailbox to which the mounting base is secured. The supporting member is connected to the signal means so that the signal means may be cause to rotate between a position generally perpendicular with the opening of the mailbox whereby the signal means is generally not visible from the opening and a position generally parallel with the opening of the mailbox whereby the signal means is visible from the opening.

11 Claims, 5 Drawing Sheets

APARTMENT MAILBOX SIGNAL DEVICE

TECHNICAL FIELD the present invention relates generally to the field of flags or signalling devices for mailboxes and the like. More particularly, the present invention relates to a detachable signal device for apartment mailboxes that allows an apartment resident to leave outgoing mail for a mail carrier in the resident's individual mailbox and alert the mail carrier that the outgoing mail shoudl be picked up.

BACKGROUND ART

There are numerous types of signalling devices presently available for rural type mailboxes to alert mail carriers that there is outgoing mail to be picked up by the mail carrier. For example, U.S. Patent Nos. 4,738,392, 4,728,028, 4,720,042, 4,711,391, 4,382,542, 4,365,740, and 4,344,559. Unfortunately, there are presently no similar types of signalling devices available for apartment mailboxes or apartment house mail receptacles. This presents a problem to apartment residents who have outgoing mail to be picked up by a mail carrier. Normally, such mail would be left by the resident in a common pick-up box or area near the apartment mailboxes. While this may be convenient for the resident and the mail carrier, it does not provide the resident with any security or assurance that such outgoing mail will actually be picked up by the mail carrier or that such outgoing mail will not be stolen prior to being picked up. If the resident attempts to leave outgoing mail inside of his or her individual locked mailbox, there is no way to indicate that this mail is to be picked up by the mail carrier and is not mail that had been previously delivered but that the resident had not picked up. Notes or messages left on the outside of an apartment mailbox indicating that there is outgoing mail inside are inconvenient and may be removed or torn down before being seen by the mail carrier. In addition, some apartment mailboxes are of a rear-loading type where themail carrier places the mail in the mailbox froma rear entrance. In these situations, the resident has no means of placing a note to be seen by the mail carrier because the resident does not have access to the rear entrance of the mailbox. Accordingly, there is a continuing need for a signal device to be used by apartment residents to alert mail carriers that there is outgoing mail in their mailboxes.

SUMMARY OF THE INVENTION

In accordance with the present invention an apartment mailbox signal device is provided including a detachable mounting base having means for engaging a rotatable arm, a generally L-shaped rotatable arm for supporting a signal means, and a signal means connected to the rotatable arm indicating the presence of outgoing mail in the mailbox.

More specifically, the apartment mailbox signal device of the present invention has a mounting base that includes means for selectively securing the mounting base to an interior wal of the apartment mailbox and means for receiving or supporting the rotatable arm. The generally L-shaped rotatable arm is comprised of a vertical pivot member and a horizontal support member. The vertical member is received within the mounting base such that it may pivot about an axis parallel with the interior wall of the mailbox to which the mounting base is secured. The supporting member is connected to the signal means so that the signal means may be cause to rotate between a position generally perpendicular with the opening of the mailbox whereby the signal means is generally not visible from the opening and a position generally parallel with the opening of the mailbox whereby the signal means is visible from the opening.

Accordingly, a primary objective of the present invention is to provide an apartment mailbox signal device that can be used within an individual apartment mailbox to signal a mail carrier that there is outgoing mail to pick-up in that mailbox.

Another objective of the present invention is to provide an aparatment mailbox signal device that is easily mounted to and detached from the interior of the apartment mailbox receptacle.

A further objective of the present invention is to provide an apartment mailbox signal device that may be used in either a horizontal-type or vertical-type apartment house mail receptacle.

These and other objectives of the present invention will become apparent with reference to the drawings, the description of the preferred embodiment and the appended claims.

FIGS. *3a–3b* show a typical inside installation for both a vertical-type and horizontal-type apartment house mail receptacle.

FIGS. *4a–4b* show a typical outside installation for both a vertical-type and horizontal-type apartment house mail receptacle.

Figure 5:
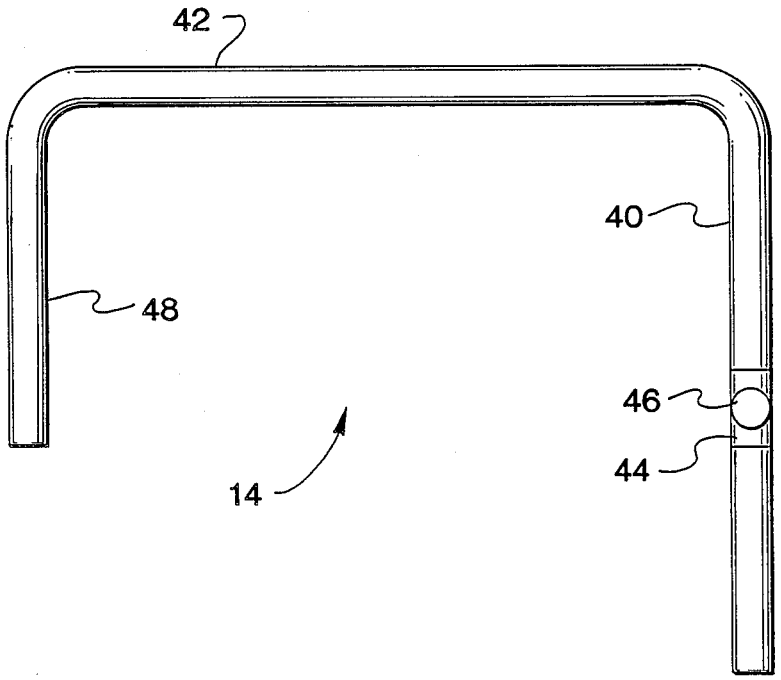

FIG. 5 shows the rotatable arm removed from the mounting base and the signal means.

FIGS. *6a* is a top view of an apartment mailbox showing the signal device of the present invention in operation.

FIGS. *6b* is a front view of an apartment mailbox showing the signal device of the present invention in operation.

DESCRIPTION OF THE PREFERRED EMBODIMENT

Figure 1:
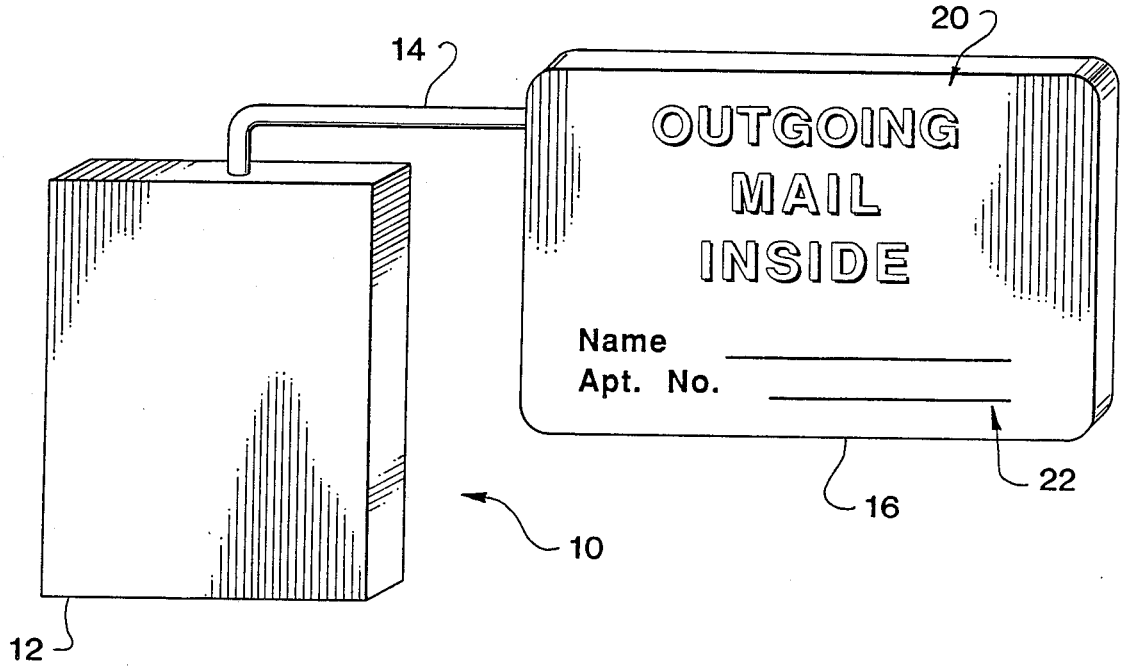
FIG. 1 is a front perspective view of a preferred embodiment of the present invention showing the outgoing mail message as seen by the mail carrier.
Figure 2:
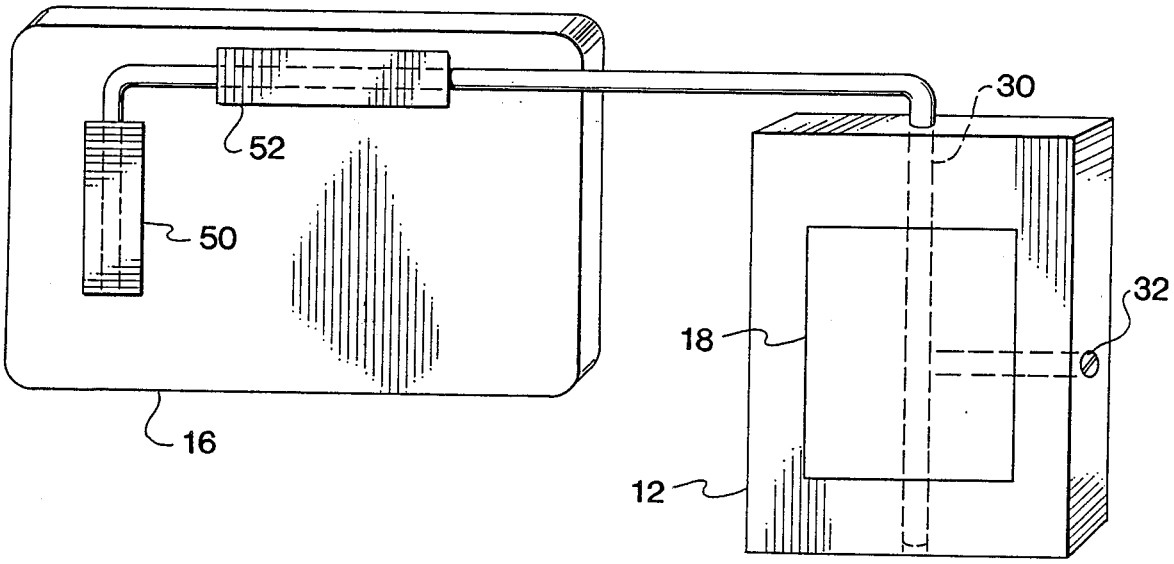
FIG. 2 is a back perspective view of a preferred embodiment of the present invention showing themanner in which the rotatable arm may be connected between the mounting base and the signal means.

Referring to FIG. 1, the operative components of a preferred embodiment of an apartment mailbox signal device 10 in accordance with the present invention include: a mounting base 12, a L-shaped rotatable arm 14 and a sign 16. As shown in FIG. 2, the signal device 10 is also provided with an attachment means 18 for detachably securing the signal device 10 to an interior wall of the mail receptacle (not shown). The attachment means 18 may be an adhesive strip, suction device, magnetic strip or any other type of attachment means capable of securing the signal device 10 in position on an interior wall of the mail receptacle. The sign 16 is provided with an outgoing mail message 20 to indicate to themail carrier that there is outgoing mail in that apartment house mail receptacle to be picked-up. The sign 16 may also be provided withan identifier 22 showing, for example, the name and apartment number of the particular mail receptacle.

Figure 3A:
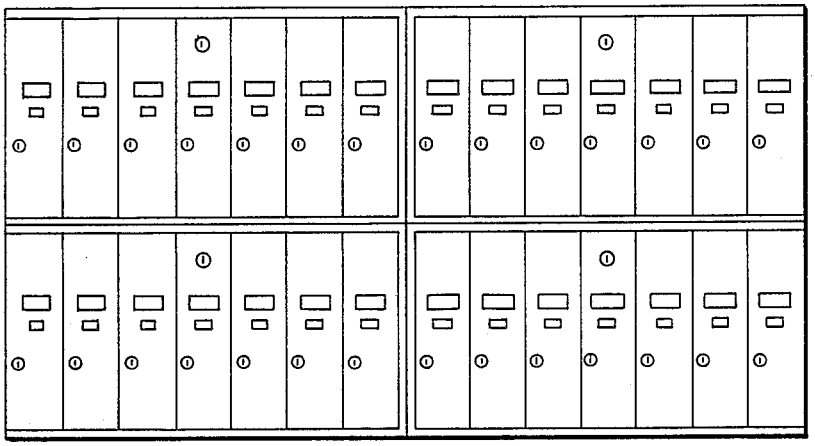
Figure 3B:
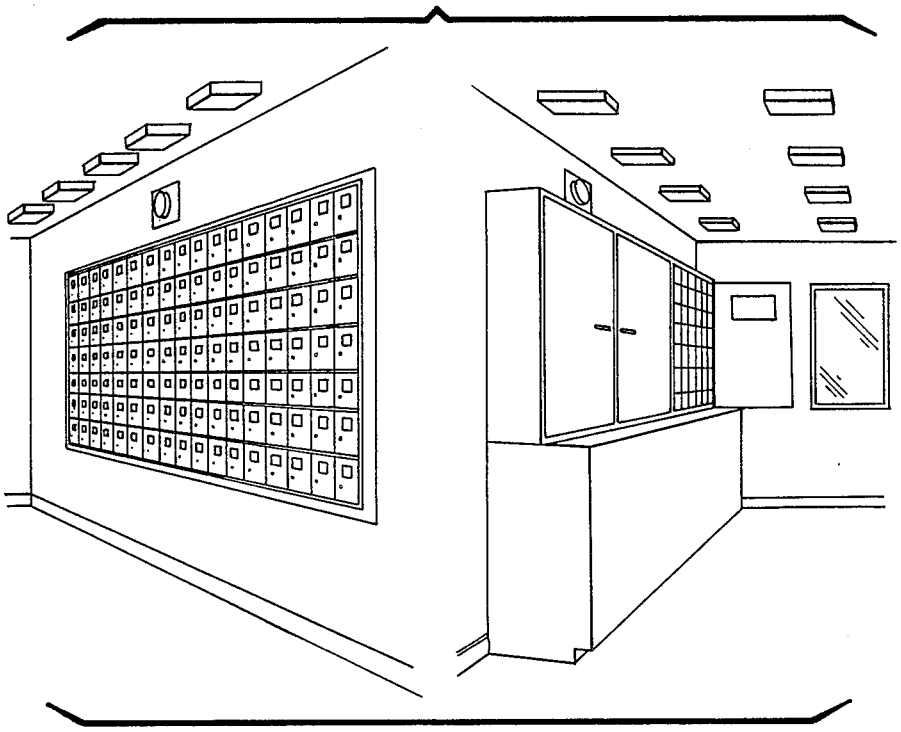
Figure 4A:
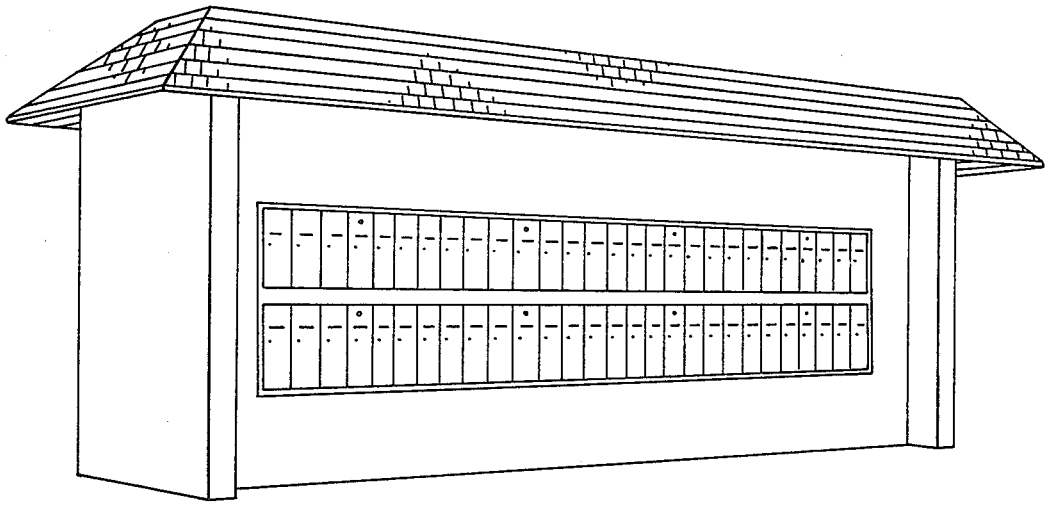
Figure 4B:
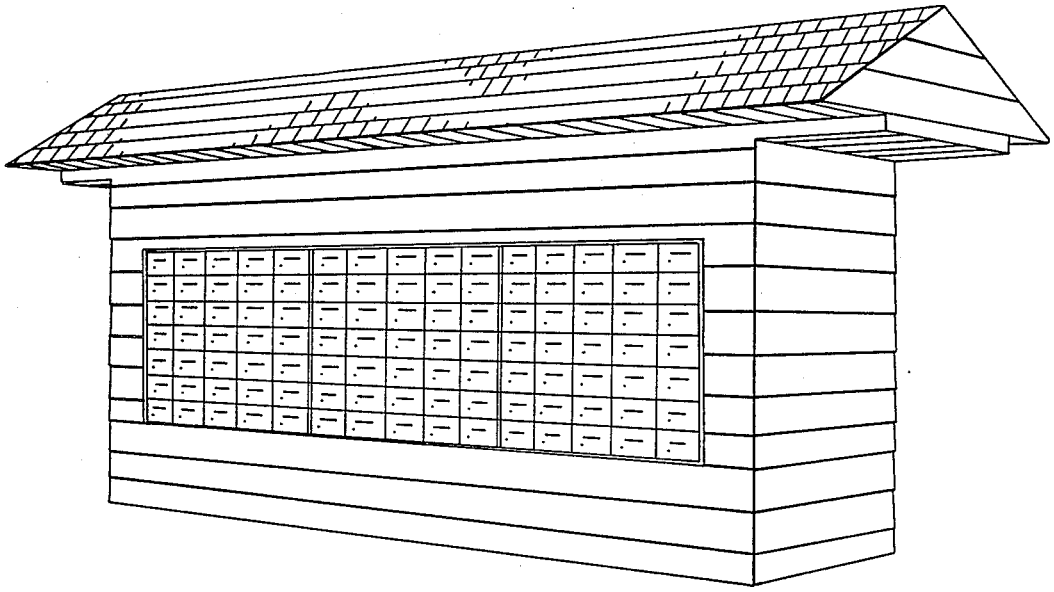

In an apartment house or multiple dwelling unit containing three or more residences occupied by different addresses, but having a common building entrance and a common shtreet address, the United States Postal Service requires the installation and maintenance of apartment house mail receptacles approved by the Postal Service. The united States Postal Service, Publication 17, 1982 entitled *Apartment House Mail Receptacles: Regulations and Manufacturing Standards,* which is fully incorporated by reference herein, sets forth the dimensions and other requirements for two types of apartment house mail receptacles: the vertical-type shown in FIG. 3*a* and FIG. 4*a;* and the horizontal-type shown in FIG. 3*b* and FIG. 4*b.* In addition to indoor and outdoor versions of both types of mail receptacles, there are two kinds of the horizontal-type mailbox: the rear-loading mailbox, as shown in FIG. 3*b,* and the front-loading mailbox as shown in FIG. 4*b.* The United States Postal Service Standard Receptacles, Apartment House, Mail [USPS-STD-4B(RDD) effective May 1, 1985]sets forth the required dimensions for both the vertical-type and horizontal-type mailboxes in Section 3.6 as follows:

3.6 Compartment Configuration - The horizontal and vertical type compartments will have minimum interior dimensions of 6 by 5 by 15 inches and receive long letter mail, small parcels and bulky magazines, unrolled as well as rolled. The individual horizontal compartment shall be of such size that a parcel 5⅞ inches wide by 4⅞ inches high by 14⅞ inches long can be inserted and removed. The individual vertical compartment shall be of such size that a parcel 4⅞ inches wide by 5⅞ inches long can be inserted and removed.

In the preferred embodiment shown in FIGS. 1 and 2, the mounting base 12 is comprised of a rectangular block of wood, plastic or other suitable material 2 inches long by 1½ inches wide by ⅜ inch thick. A throughbore 30 located in the approximate middle of the top end of the mounting base 12 and having a diameter of 3/16 inch is drilled lengthwise through the mounting base 12 to receive the rotatable arm 14. A thraded-bore 32 located in the approximate middle of one side of the mounting base and having a diameter of ⅛ inch is drilled widthwise through the mounting base until the threaded-bore 32 intersects with the throughbore 30. The threaded-bore 32 is adpated to receiving a screw 34 having a concave end for frictionally engaging the rotatable arm 14 when the rotatable arm 14 is inserted in throughbore 30.

As shown in FIG. 5, the rotatable arm 14 is comprised ofa generally L-shaped cylindrical member having a vertical pivot member 40 adapted to be inserted in the throughbore 30 in the mounting base 12 and a horizontal support member 42 at a right angle to the pivot member 40 for supporting the sign 16. The pivot member 40 is provided with a radial groove 44 approximately halfway down the length of the pivot member 40. The radial groove 44 serves to vertically position the arm 14 in the throughbore 40 by engaging the screw 34 extending into throughbore 30 from threaded-bore 32. With the concave end of screw 34 extending just into the throughbore 30, the arm 14 is slidably inserted into the top of the mounting base 12 and downward into throughbore 30 until the screw 34 snaps into position in the radial groove 44, thereby vertically positioning the arm 14 within the throughbore 40. The radial groove 44 may also be provided with one or more detents 46 in the form of frustoconical indentions along the radial groove 44. The detent 46 is positioned at that point on the radial groove where the arm 14 is in the visible position perpendicular to the mounting plate 12 as shown in FIG. 6 (SET position). The presendce of the detent 46 provides a stabilizing position for the arm 14 to be rotated to when the sign 16 is pivoted to the SET position by engaging the concave end of the screw 34 in the detent 46 as the radial groove 44 is rotated by the screw. By providing two detents 46 on opposite sides of the radial groove 44, the operation of arm 14 in throughbore 40 is made independent of which side the threaded-bore 32 is on or which end of the throughbore 40 the arm 14 is inserted in.

In a preferred embodiment, the sign 16 a generally rectangular plastic or wood plate, 3⅜ inches wide by 2 inches tall and ⅛ inch thick. The exact size and shape of the sign 16 are not critical to the invention so long as the overall dimensions of the signal device 10 in operation are less than the minimum dimensions 5 inches by 6 inches for the interior of either a horizontal-type or vertical-type apartment house mail receptacle. The message 20 in the preferred embodiment reads: "OUTGOING MAIL INSIDE". It will be apparent that many types of messages could be used to convey to the mail carrier that there is mail to be picked-up within the mailbox. For example, the message may read "MAIL-FOR PICK-UP" or there may be no message at all, but simply a red flag that would also alert the mail carrier that there is mail to be picked-up within the mailbox.

In one embodiment, the arm 14 is also provided with a second vertical member 48 at the opposite end of support member 42 as part of the means for attaching the sign 16 to the arm 14. In this embodiment, the member 48 is slidably inserted into a tubular member 50 that is fixed to the rear of the sign 16 in a vertical position as shown in FIG. 2. The vertical position of the arm 14 is fixed by snappably inserting the support member 49 into a channel 52 that is fixed to the rear of the sign 16 in a horizontal position as shown in FIG. 2. It will be seen that there are many other ways of attaching the arm 14 to the sign 16 including, for example, gluing the support member 42 to the rear of the sign 16, slidably inserting support member 42 into tubular member horizontally affixed to the rear of the sign 16 that is provided with some type of locking mechanism for preventing the sign 16 from sliding off the support member 42, or any number of other attachment methods. It will also be seen that while the arm 14 in the preferred embodiment is fashioned from a a metal rod having of an ⅛ inch diameter, many other types of materials and configuration for the arm 14 could be used and still be within the scope of the present invention. For example, the support member 42 might have a square cross-section or might be molded integral with the sign 16 as a single piece. One advantage of the preferred embodiment is that the sign 16 may be positioned at angles other than parallel with the support member 42 by snappably releasing the support member 42 from the channel 52 and pivoting the sign 16 about the second member 48. In an alternative embodiment, a second tubular member (not shown) could be positioned on the rear of the sign 16 parallel to the tubular to allow the tubular member 40 but on the opposite end of the sign 16 so that the second vertical member 48 could be optionally inserted in this second tubular member to allow the signal device 10 to be placed on either the right or left interior wall of the apartment mailbox.

Figure 6A:
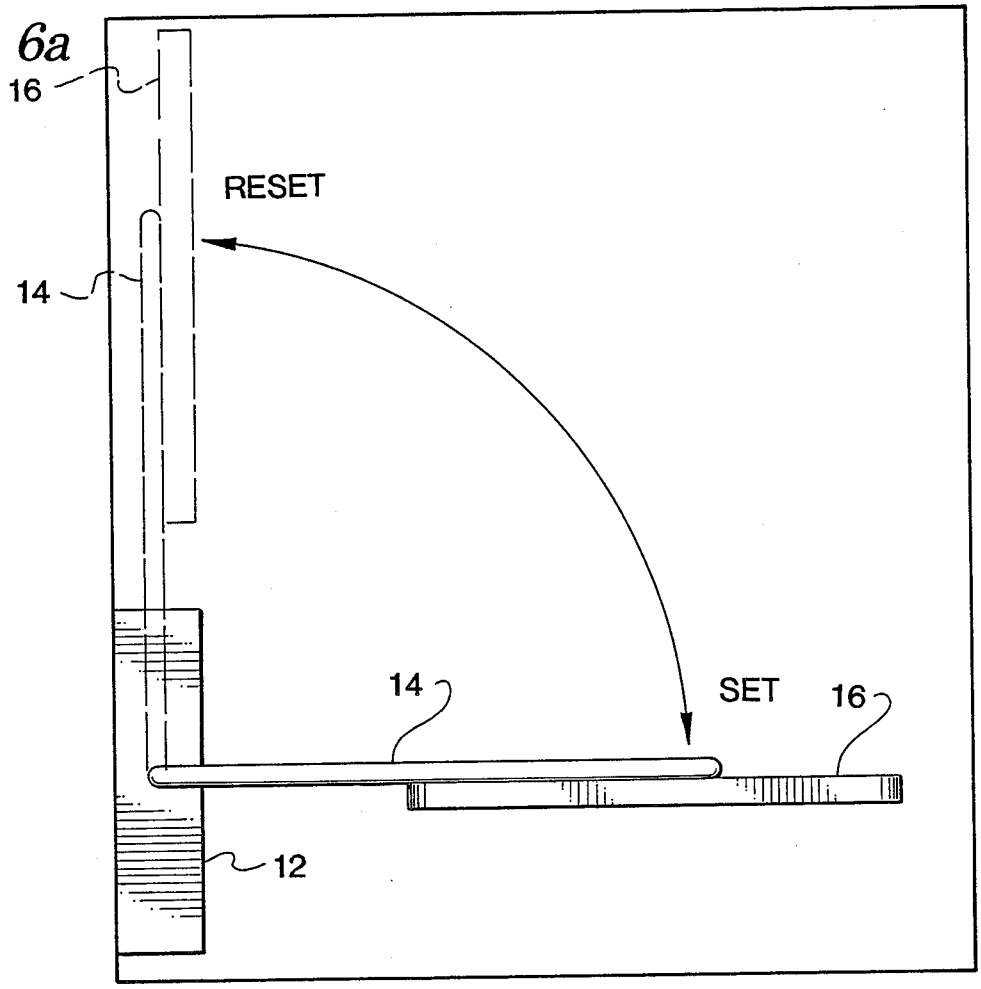
Figure 6B:
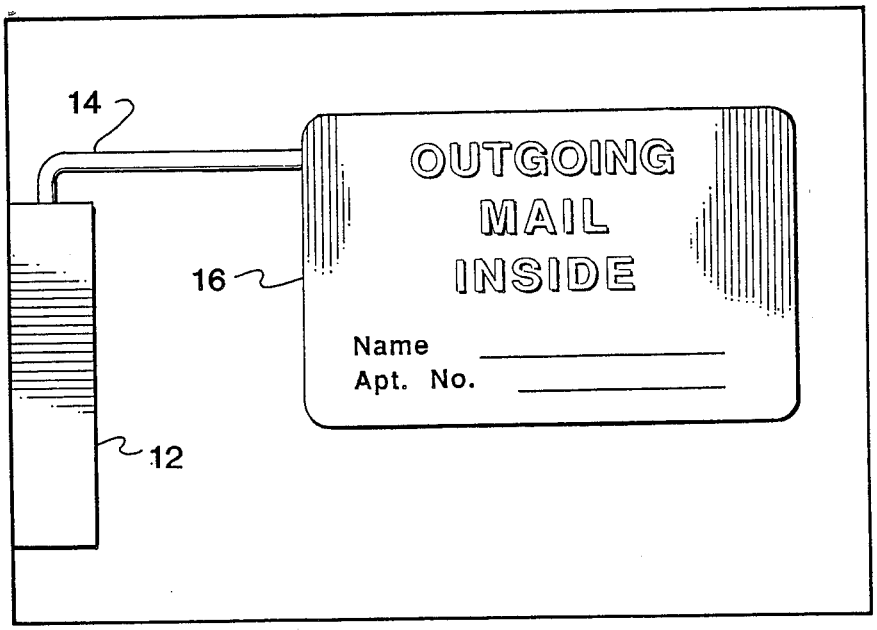

Referring not to FIGS. 6*a* and 6*b*, the operation of the signal device in the apartment mailbox will be described. To use the signal device 10 in a front-loading horizontal-type apartment house mail receptacle, the signal device 10 would be placed on the left hand vertical interior wall 60 of the mailbox with the mounting base 12 forward of the sign 16 as shown in the RESET position in FIG. 6*a*. When the resident has outgoing mail to be picked-up by the mail carrier, the outgoing mail is placed in the mailbox and the sign 16 is moved from the RESET position to the SET position. Upon opening the master door for the apartment house mail receptacle, the mail carrier would see the sign 16 as shown in FIG. 6*b* and remove the outgoing mail. In doing so, the mail carrier's hand pushes the sign 16 back to the RESET position so that the signal device 10 will not interfere with the placement of mail being delivered to the mailbox. For a rear-loading mailbox, the operation is identical only the signal device 10 would be located on the right-hand interior wall of the maibox as seen by the resident, with the sign 16 facing the rear of the mailbox. For vertical-type mailboxes, the signal device 10 is again placed on the left-hand interior wall of the mailbox as seen by the resident, only the mounting base 12 is now positioned above the the sign 16 so that the sign 16 may pivot about a horizontal axis, rather than a vertical axis as for the horizontal-type mailboxes. With the vertical-type mailboxes, the mail carrier places themail in the receptacles by opening the top of the unit and pivoting the entire unit outward so that mail may be dropped into the top of the receptacles. In this situation, the signal device 10 will normally be visible to the mail carrier from the top of the receptacle as shown in FIG. 6*b*. Even in those circumstances where the top of the vertical-type mail receptacle is to tall for the signal device 10 to be visible by the mail carrier, the mail carrier would notice the signal device 10 in the SET position when attempting to place mail to be delivered into the top of the receptacle. For this reason, it is desirable to place the signal device 10 near the top of the left-hand interior wall of the vertical-type mail receptacles so that it is most visible to the mail carrier.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

I claim:

1. An apartment mailbox signal device for use inside an apartment mailbox having at least one opening for receiving mail, comrpsing:

signal means for indicating the presence of outgoing mail in the mailbox;

a generally L-shaped rotatable arm operably connected to the signal means for supporting the signal means and selectively rotating the signal means; and a detachable mounting base including:

means for selectively securing the mounting base to an interior wall for the apartment mailbox; and means for receiving the rotatable arm and allowing the rotatable arm to pivot about an axis generally parallel with the interior wall of the apartment mailbox to which the mounting base is secured, such that the signal means may rotate between a position generally perpendicular with the opening whereby the signal means is generally not visible from the opening and a position generally parallel with the opening whereby the signal means is visible form the opening.

2. The apartment mailbox signal device of claim 1 wherein the signal means is a generally rectangular plate having a message printed on the surface facing the opening of the mailbox when the signal means is in the position parallel with the opening.

3. The apartment mailbox signal device of claim 1 wherein the means for selectively securing the mounting base to an interior wall of the apartment mailbox is an adhesive strip attached to the surface of the mounting base adjacent the interior wall.

4. The apartment mailbox signal device of claim 1 wherein the means for selectively securing the mounting base to an interior wall of the apartment mailbox is a magnetic strip attached to the surface of the mounting base adjacent the interior wall.

5. The apartment mailbox signal device of claim 1 whereint eh rotatable arm is a generally L-shaped cylindrical member having a vertical pivot member to be recieved by the means for receiving the rotatable arm and a horizontal support member operably connected to the signal means.

6. The apartment mailbox signal device of claim 5 wherein the means for receiving the rotatable arm and allowing the rotatable arm to pivot is comprised of a cylindrical bore in the mounting base in a plane parallel to the interior wall.

7. The apartment mailbox signal device of claim 6 wherein the means for receiving the rotatable arm and allowing the rotatable arm to pivot further comprises a second bore in the mounting base in a plane parallel to the interior wall generally perpendicular to the cylindrical bore and frictional positioning means for positioning the vertical pivot member in the cylindrical bore.

8. The apartment mailbox signal device of claim 7 wherein the means for positioning the vertical pivot member is a screw and the second bore is a threaded-bore.

9. The apartment mailbox signal device of claim 8 wherein the vertical pivot member includes a radial groove for engaging with the means for positioning the vertical pivot member.

10. The apartment mailbox signal device of claim 9 wherein the vertical pivot member further includes a plurality of detents along the radial groove for frictionally engaging with the means for positioning the vertical pivot member to create a catch position in the rotation of the signal means.

11. An apartment mailbox signal device for use inside an apartment mailbox having at least one opening for receiving mail, comprising:

a sign indicating the presence of outgoing mail in the mailbox;

a generally L-shaped rotatable arm having a horizontal support member operably connected to the sign and a vertical pivot member for rotating the sign having a radial groove and at least one detent in the radial groove; and a detachable mounting base including:

means for selectively securing the mounting base to an interior wall of the apartment mailbox;

a throughbore for receiving the vertical pivot member and allowing the rotatable arm to pivot about an axis generally parallel with the interior wall of the apartment mailbox to which the mounting base is secured, such that the sign may rotate between a position generally perpendicular with the opening and a position genreally parallel with the opening;

a threaded-bore perpendicular to the throughbore; and a screw for positioning the vertical pivot member in the throughbore, vertically by engaging the radial groove and horizontally by engaging the detent in the radial groove.

* * * * *